US006239781B1

(12) United States Patent
Fujisawa

(10) Patent No.: US 6,239,781 B1
(45) Date of Patent: May 29, 2001

(54) GRAY-SCALE SIGNAL GENERATING CIRCUIT AND LIQUID CRYSTAL DISPLAY

(75) Inventor: Yosimitsu Fujisawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 08/944,436

(22) Filed: Oct. 6, 1997

(30) Foreign Application Priority Data

Oct. 16, 1996 (JP) ..... 8-273284
Jun. 25, 1997 (JP) ..... 9-168581

(51) Int. Cl.[7] ..... G09G 3/36

(52) U.S. Cl. ..... 345/147; 345/89; 345/148; 345/149; 345/208

(58) Field of Search ..... 345/147, 148, 345/89, 149, 208

(56) References Cited

U.S. PATENT DOCUMENTS 5,459,495 * 10/1995 Scheffer et al. ..... 345/147
5,485,173 * 1/1996 Scheffer et al. ..... 345/100
5,877,738 * 3/1999 Ito et al. ..... 345/94
5,912,651 * 6/1999 Bitzakidis et al. ..... 345/58
5,959,603 * 9/1999 Ito et al. ..... 345/100

FOREIGN PATENT DOCUMENTS 0 193 728 A2 9/1986 (EP) .
0 513 551 A2 11/1992 (EP) .

OTHER PUBLICATIONS

English Language Abstract of Japanese Patent Application No. 04287584, Oct. 13, 1992.

* cited by examiner

*Primary Examiner*—Bipin Shalwala
*Assistant Examiner*—Vincent E. Kovalick
(74) *Attorney, Agent, or Firm*—Wenderoth, Lind & Ponack, LLP.

(57) ABSTRACT

A gray-scale generating circuit having a waveform that represents the gray level of a picture element over a certain number of frames of an image, the picture element being scanned during a certain interval in each frame. Each interval is divided into parts. The waveform has either a high level or a low level in each part of each interval thereby obtaining a set of waveform parts. The level of each of the waveform parts of the waveform, taken collectively over the intervals in the above number of frames, is variable and set according to the gray level of the picture element. In a matrix-addressed display, the waveforms are varied so that the waveforms of side-by-side picture elements do not all go high and low in unison.

10 Claims, 9 Drawing Sheets

GRAY-SCALE SIGNAL GENERATING CIRCUIT AND LIQUID CRYSTAL DISPLAY

BACKGROUND OF THE INVENTION

The present invention relates to a circuit for generating a gray-scale signal of the pulse-width modulation type, and to a matrix-addressed liquid crystal display employing this circuit.

In many liquid crystal displays, each picture element has only on and off states, so intermediate gray levels are displayed by switching the picture element on and off repeatedly arid controlling the on-off duty cycle. This technique is known as frame rate control, or more generally as pulse-width modulation. In a color display, such as a color liquid crystal television set, this technique can be used to display a large number of colors by mixing different intensities or red, blue, and green. The term 'gray scale' is commonly employed to denote these intensities, even though color is involved. Liquid crystal television sets employ matrix addressing, in which the picture elements on the display screen are scanned a line at a time.

A problem that arises is that to display the large number of gray levels needed for a natural display appearance, the interval of time during which a picture element is scanned must be finely divided, requiring a high-frequency timing clock signal. The use of a high-frequency clock signal increases the power dissipation of the display. In addition, the liquid crystal material must be capable of responding to voltage changes at speeds comparable to the speed of the timing clock signal, but liquid crystal materials with very fast response times are not easy to find.

SUMMARY OF THE INVENTION

It is accordingly an object of the present invention to reduce the frequency of the timing clock signal needed for generating a gray-scale signal by pulse-width modulation.

A further object of the invention is to avoid causing flicker.

A gray-scale signal generated according to the present invention represents a gray level of a picture element in an image that is displayed in successive frames, the picture element being scanned during a certain interval in each frame. Each of these intervals is divided into a first number of parts. A waveform is generated as a set of waveform parts for these intervals in a second number of frames the set of waveform parts, having either a high level or a low level in each waveform part of each interval in each frame. The set of waveform parts covers a total number of parts equal to the first number multiplied by the second number. Among this total number of parts, the waveform parts are high for a number of parts that is variable in steps of one part and responsive to the gray level of the picture element. The gray-scale signal is generated from this waveform as a set of waveform parts.

When the invented method is applied to drive multiple picture elements in a display, the timing of the gray-scale signals is varied so that, even if a certain number of side-by-side picture elements have identical gray levels, their gray-scale signals have waveforms that do not all go high and low in unison.

DETAILED DESCRIPTION OF THE INVENTION

Two embodiments of the invention will be described with reference to the attached illustrative drawings. Both embodiments generate gray-scale signals for use in a color liquid crystal display. The first embodiment outputs eight gray levels. The second embodiment outputs sixteen gray levels.

Figure 1:
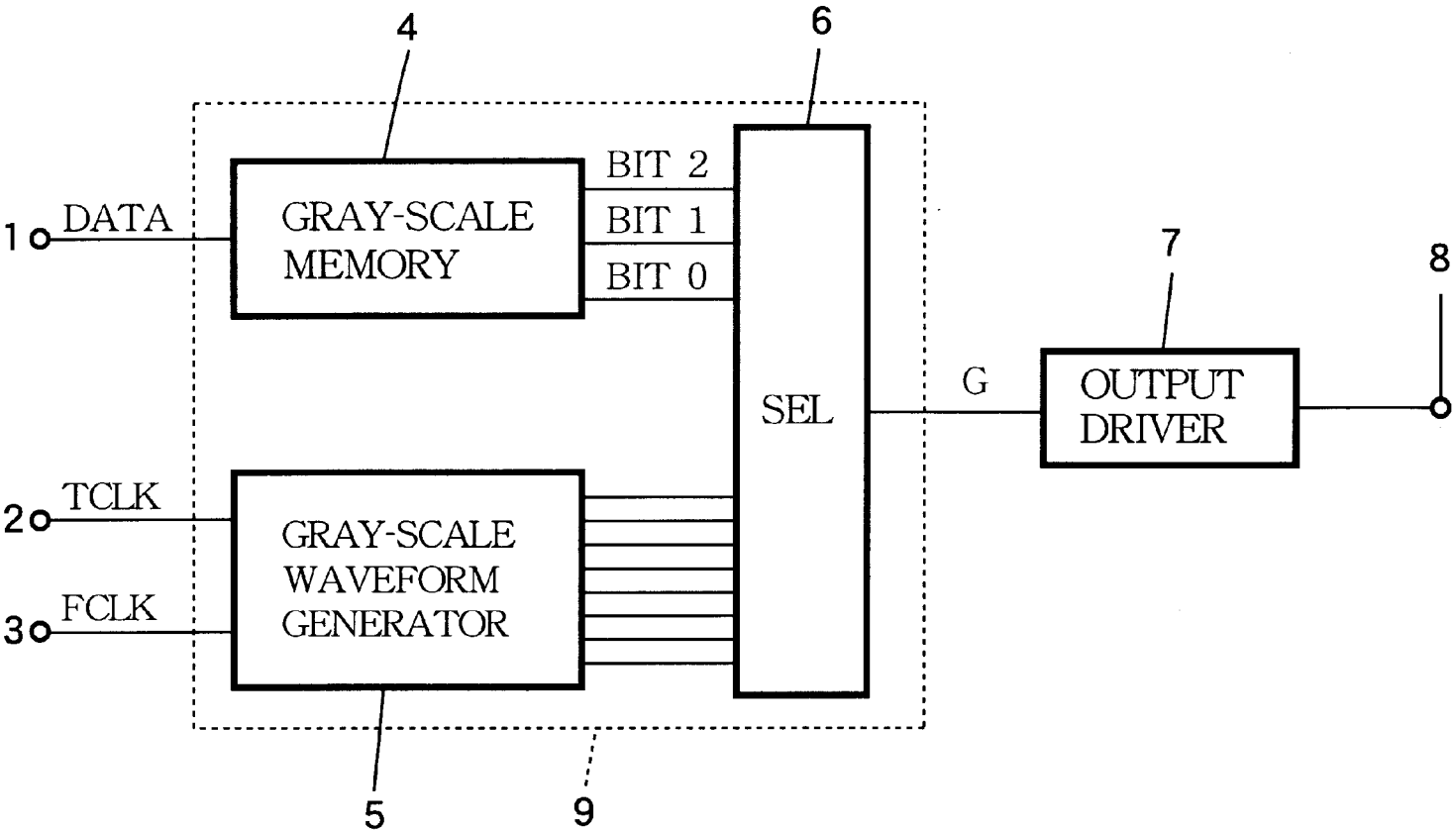
FIG. 1 is a block diagram of a gray-scale signal generating circuit in a first embodiment of a invention.

Referring to FIG. 1, the first embodiment comprises a data input terminal 1, a timing clock (TCLK) input terminal 2, a frame clock (FCLK) input terminal 3, a gray-scale memory 4, a gray-scale waveform generator 5, a selector 6, an output driver 7, and an output terminal 8. The gray-scale memory 4, gray-scale waveform generator 5, and selector 6 constitute a gray-scale control circuit 9.

The output driver 7 is coupled to a column electrode in a liquid crystal display (not shown) and drives one column of picture elements of one primary color (red, blue, or green). The display is scanned a line at a time, a line comprising a row of picture elements. The display has a separate output driver 7 for each primary color in each column, and scans all columns simultaneously.

A displayed picture signal is, for example, a digital television signal that is divided into successive frames, each frame comprising successive lines, and each line comprising successive picture elements. To convert to the line-at-a-time scanning scheme used in a liquid crystal display, the signal must be stored in a memory device. The gray-scale memory 4 stores the data for one primary color, for at least one picture element in one column of one frame.

The frame clock received by the gray-scale waveform generator 5 has a period equal to two frame periods. A frame clock signal of this type can be generated from a frame pulse signal, comprising one pulse at the beginning of each frame, by feeding the pulses as a clock signal to a flip-flop circuit configured so as to output a signal that inverts between the high and low states at each pulse.

The timing clock has a period equal to one-fourth of the duration of one line-scanning interval. During each line-scanning interval, the gray-scale waveform generator 5 outputs eight pulse-width-modulated gray-scale waveforms. The selector 6 selects one of these waveforms according to data for one picture element, read from the gray-scale memory 4, and thereby generates a gray-scale waveform G. The output driver 7 converts the waveform G to a gray-scale signal with voltage levels needed to drive the liquid crystal display.

The gray-scale memory 4 has three output signal lines, each carrying one bit of output data. These bits indicate eight gray levels, from zero to seven, as shown in Table 1.

TABLE 1

| Level | Bit 2 | Bit 1 | Bit 0 |
|---|---|---|---|
| 0 | 0 | 0 | 0 |
| 1 | 0 | 0 | 1 |
| 2 | 0 | 1 | 0 |
| 3 | 0 | 1 | 1 |
| 4 | 1 | 0 | 0 |
| 5 | 1 | 0 | 1 |
| 6 | 1 | 1 | 0 |
| 7 | 1 | 1 | 1 |

Figure 2:
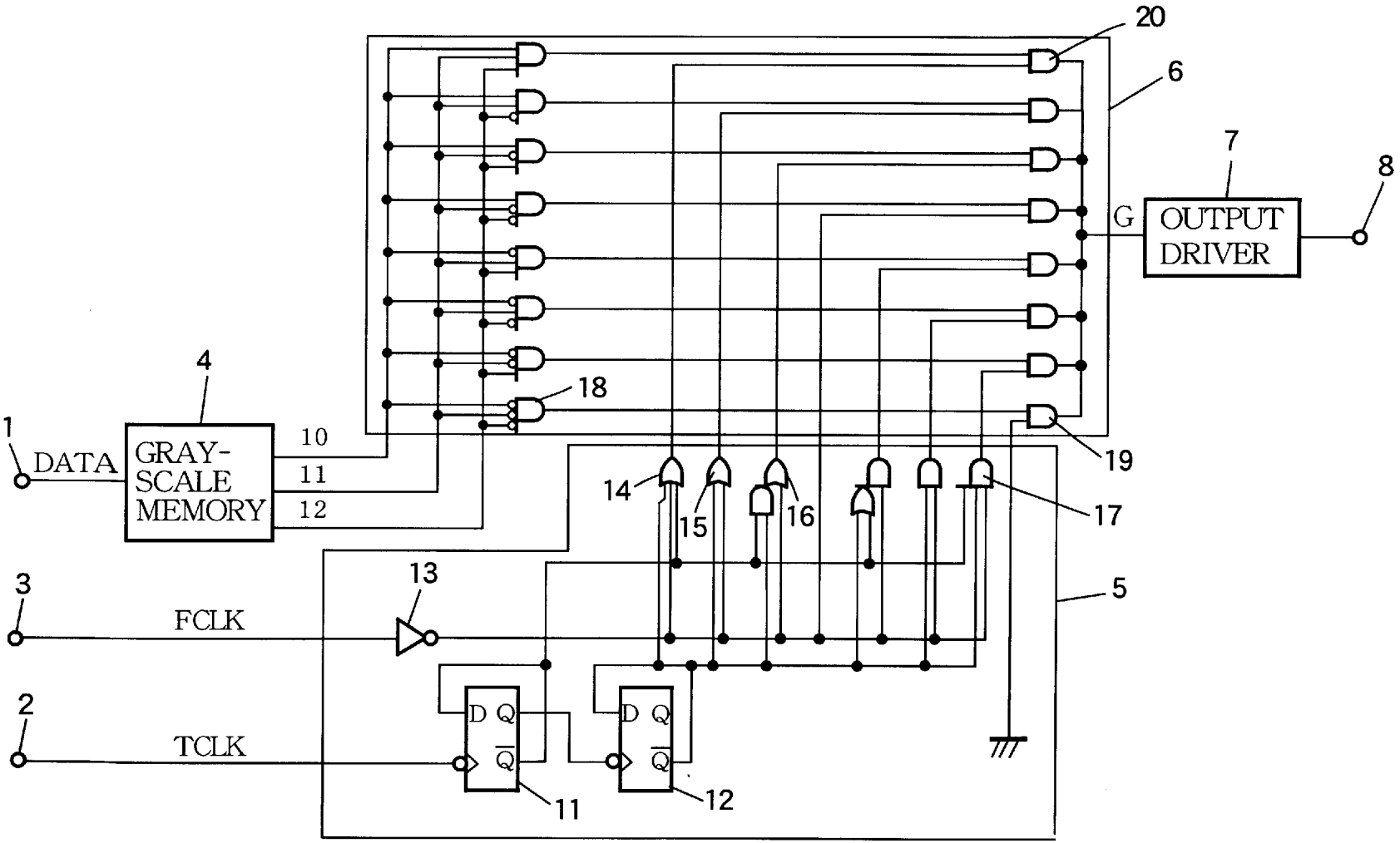
FIG. 2 is a schematic drawing of the gray-scale waveform generator and selector in the first embodiment.

FIG. 2 shows the internal structure of the gray-scale waveform generator 5 and selector 6.

The gray-scale waveform generator 5 comprises a pair of D-type flip-flops 11 and 12 interconnected so as to divide the frequency of the timing clock signal (TCLK) by factors of two and four, an inverter 13 that inverts the frame clock signal (FCLK), and eight logic gates, such as a three-input OR gate 14, two-input OR gate 15, two-input AND gate 16, and three-input AND gate 17, that perform logic operations on outputs of the flip-flops 11 and 12 and inverter 13. These operations generate eight different candidate waveforms, which are supplied to the selector 6.

The selector 6 comprises eight three-input AND gates that decode the bit signals from the gray-scale memory 4. AND gate 18, for example, takes the logical AND of the inverted values of bits zero, one, and two.

The selector 6 also comprises eight two-input AND gates, from AND gate 19 to AND gate 20. Responding to the output of three-input AND gate 18, the two-input AND gate 19 selects an always-low ground waveform output from the gray-scale waveform generator 5, when bits zero, one, and two received from the gray-scale memory 4 are all low. The other two-input AND gates in the selector 6 select waveforms generated by the logic circuits in the gray-scale waveform generator 5, according to the outputs of the other three-input AND gates in the selector 6.

The outputs of these two-input AND gates, from the AND gate 19 to the AND gate 20, are coupled in a wired-OR configuration to generate the gray-scale waveform G. The level of waveform G is low when the outputs of all of the two-input AND gates in the selector 6 are low, and high when the output of at least one of the two-input AND gates in the selector 6 is high.

Next, the operation of the first embodiment will be described.

Figure 3:
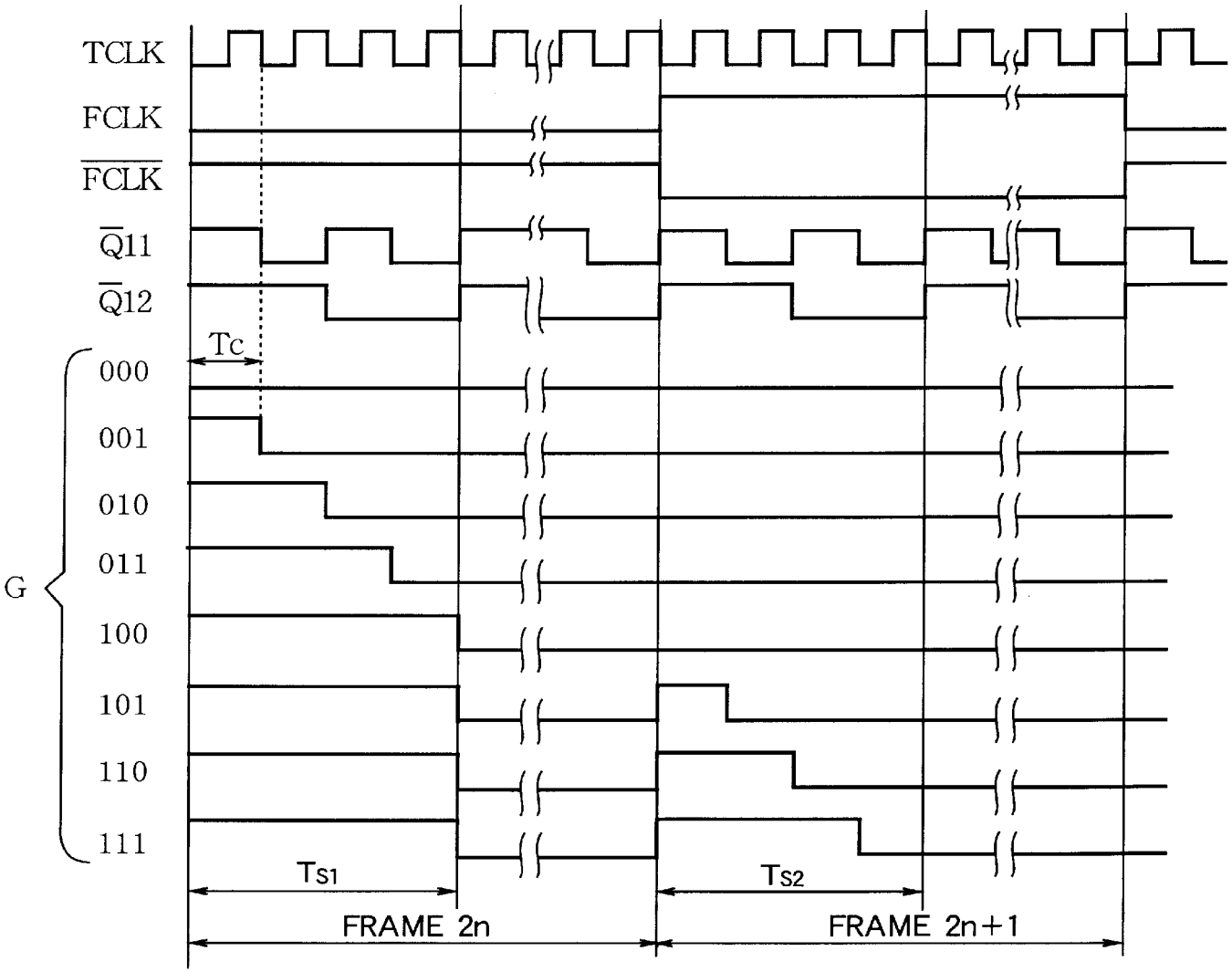
FIG. 3 is a timing diagram illustrating the operation of the first embodiment.

FIG. 3 shows waveforms of the timing clock signal (TCLK), the frame clock signal (FCLK), the inverted frame clock signal ($\overline{FCLK}$) generated by inverter 13, the output $\overline{Q}$11 of flip-flop 11, the output $\overline{Q}$12 of flip-flop 12, and the output G of the selector 6 for input data values from zero ('000') to seven ('111'). The output waveforms C are shown during the scanning intervals $T_{S1}$ and $T_{S2}$ of the first line in two successive frames: an even-numbered frame 2*n*, and the following odd-numbered frame 2*n*+*1*. In each waveform, the high level corresponds to logic one, and the low level to logic zero.

The output waveforms C represent the gray level of one picture element in the first line, under the assumption that the data for this picture element do not change between frames 2*n* and 2*n*+1. The generation of two of the output waveforms is described below, with reference to both FIGS. 2 and 3.

If the gray level is zero ('000'), then the output of AND gate 18 in the selector 6 goes high, causing AND gate 19 to select the ground-level waveform output of the waveform generator 5. The outputs of all other AND gates in the selector 6 are low. The waveform G output by the selector 6 accordingly stays low during both intervals $T_{S1}$ and $T_{S2}$.

If the gray level is one ('001'), then the output of the three-input AND gate above gate 18 goes high, causing the two-input AND gate above gate 19 to select the output of AND gate 17 in the gray-scale waveform generator 5. This output is high when $\overline{FCLK}$, $\overline{Q}$11, and $\overline{Q}$12 are all high, a condition which occurs during the first timing clock period Tc of line interval $T_{S1}$.

The other output waveforms are generated by similar logic operations that can be readily verified from FIG. 2. As FIG. 3 shows, the first embodiment carries out pulse-width modulation of the gray-scale waveform G over a period of two successive frames, thereby obtaining eight gray levels, even though the timing clock signal TCLK divides each line-scanning interval into only four waveform parts of duration Tc. This is because the waveform spans two line-scanning intervals, comprising a total of eight waveform parts of duration Tc, and the number of these parts in which the waveform is high can be varied in steps of one part.

The gray-scale waveform G comprises, not only a waveform for the picture element in the first scanning line, but other waveforms for the picture elements in the same column in other scanning lines, following one after another in each frame.

If the gray level of a picture element changes from, for example, zero ('000') in frame 2*n* to four ('100') in frame 2*n*+1, the output signal G will remain low throughout interval $T_{S2}$, as if the change had not occurred. However the gray level remains at four ('100') or a higher gray level in the next frame 2*n*+2, the output signal G will go high throughout the first line-scanning interval in frame 2*n*+2. There may be, accordingly, a one-frame delay in the output of the new gray level, but at television frame rates, this delay is not readily noticeable.

Figure 4:
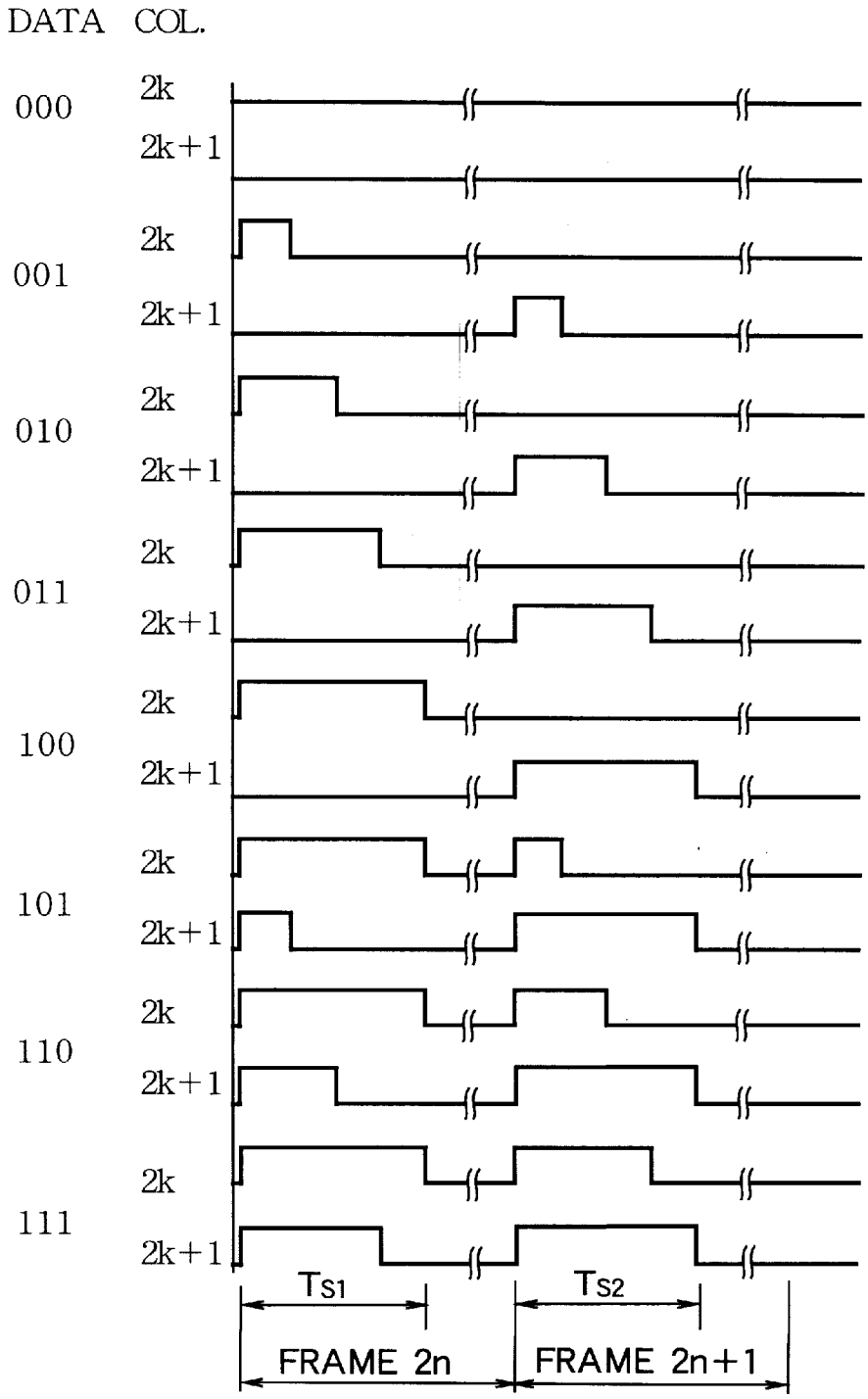
FIG. 4 is a timing diagram illustrating the operation of the first embodiment when used to drive two adjacent columns of picture elements in a liquid crystal display.

When the first embodiment is employed to drive a liquid crystal display, the circuit configuration shown in FIG. 2 is used to drive, for example, the even-numbered columns. In the odd-numbered columns, the circuit configuration is varied by removing the inverter 13 from the gray-scale waveform generator 5. FIG. 4 illustrates the result of this removal, showing the gray-scale waveforms G in an even-numbered column 2*k* and the adjacent odd-numbered column 2*k*+1 for each gray level from zero ('000') to seven ('111'). Removing the inverter 13 to reverses the even-frame and odd-frame halves of the waveforms G in the odd-numbered columns. Accordingly, even if a picture element in column 2*k* and the adjacent picture element in column 2*k*+1 have the same gray level, their gray-scale waveforms to not go high and low in unison.

This arrangement avoids flicker. Consider, for example, a display in which all gray levels are in the range from zero ('000') to four ('100'). If all output drivers 7 were to receive the waveforms G illustrated in FIG. 3, then all high-level portions would be concentrated in the even-numbered frames and the entire screen would go to gray level zero during odd-numbered frames, creating an obvious flicker effect. With the waveforms in FIG. 4, however, the high-level portions are distributed equally among the even-numbered and odd-numbered frames, and the flicker disappears.

Incidentally, while each column requires a separate output driver 7, selector 6, and gray-scale memory 4, a single gray-scale waveform generator 5 can be shared by a plurality of selectors 6 in even-numbered columns, and a single gray-scale waveform generator 5 with the inverter 13 removed can be shared by a plurality of selectors 6 in odd-numbered columns.

Figure 5:
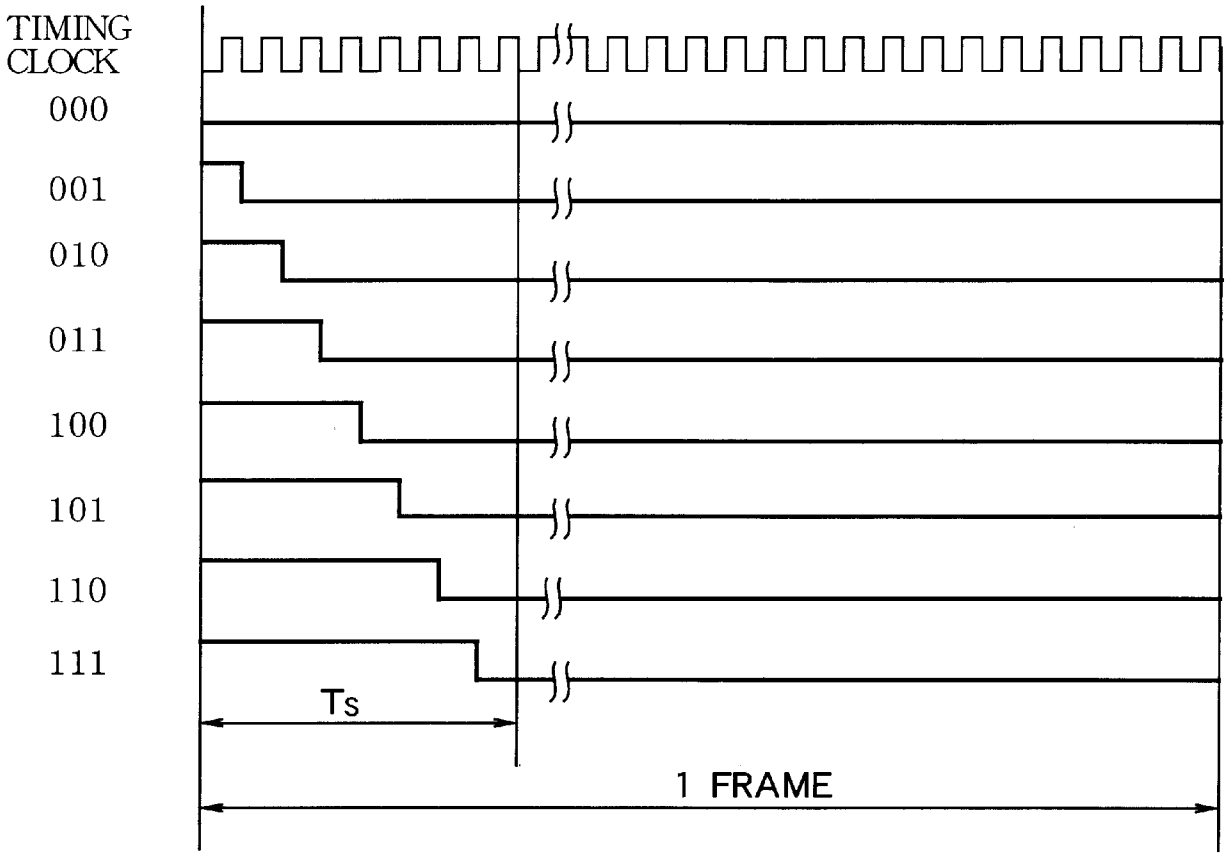
FIG.5 PRIOR ART
FIG. 5 is a timing diagram illustrating the operation of a conventional gray-scale signal generating circuit.

For comparison with the first embodiment, FIG. 5 shows the conventional method of producing eight gray levels by pulse-width modulation within one frame. To divide the line-scanning interval $T_S$ into eight parts, the timing clock signal frequency must be twice as high as in the first embodiment, and power dissipation increases accordingly.

Next, the second embodiment will be described. The second embodiment employs the same timing and frame clock signals as the first embodiment, but obtains twice as many gray levels.

Figure 6:
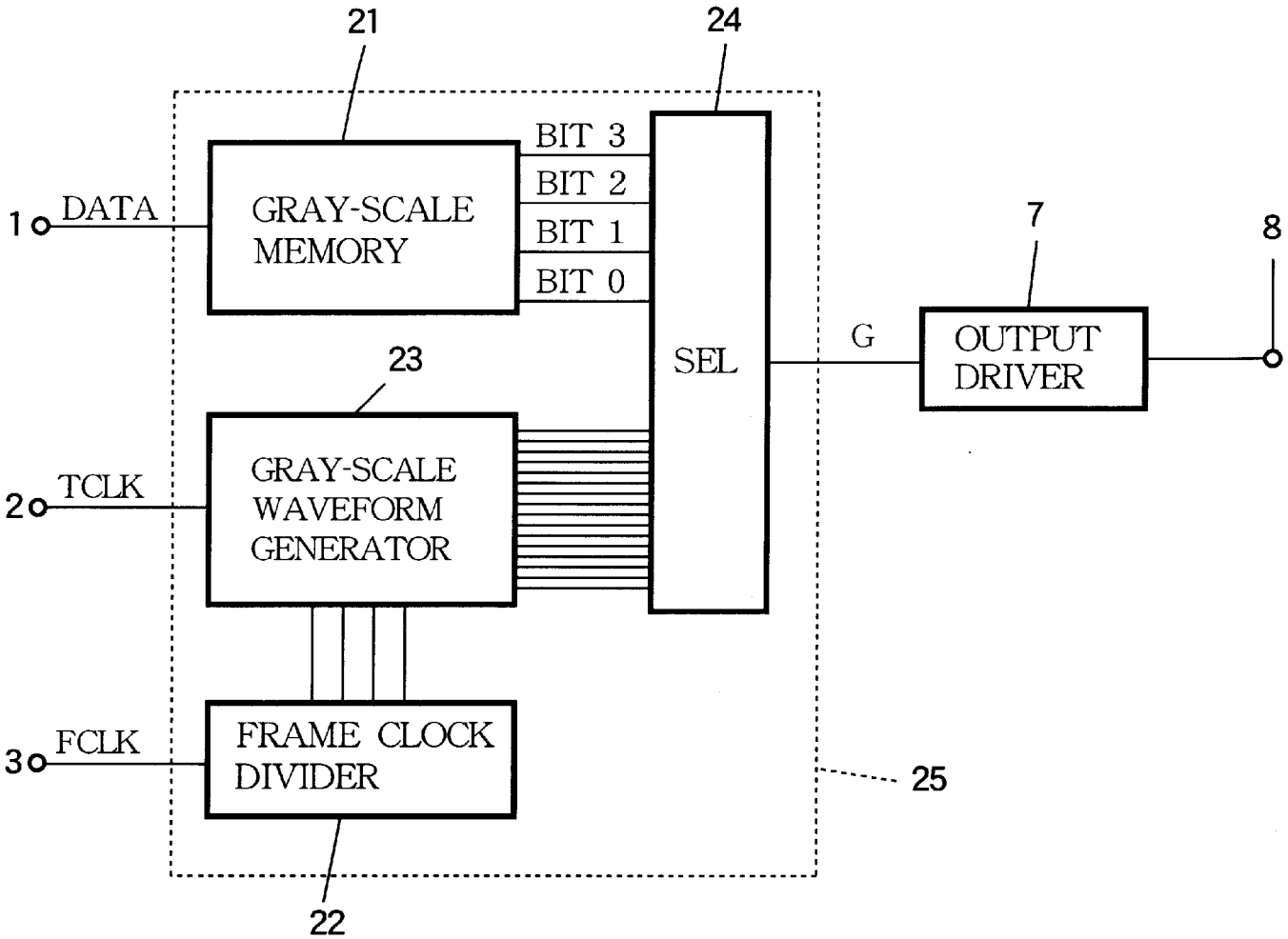
FIG. 6 is a block diagram of a gray-scale signal generating circuit in a second embodiment of the invention.

Referring to FIG. 6, the second embodiment has the same input terminals 1, 2, and 3, output terminal 8, and output driver 7 as in the first embodiment. The gray-scale memory 21 in the second embodiment outputs four-bit data, bit three being the most significant bit. A frame clock divider 22 divides the frequency of the frame clock (FCLK) by two. The gray-scale waveform generator 23 supplies sixteen gray-scale waveforms to the selector 24, which selects one of these waveforms according to the output of the gray-scale memory 21. The gray-scale memory 21, frame clock divider 22, gray-scale waveform generator 23, and selector 24 constitute a gray-scale control circuit 25.

Figure 7:
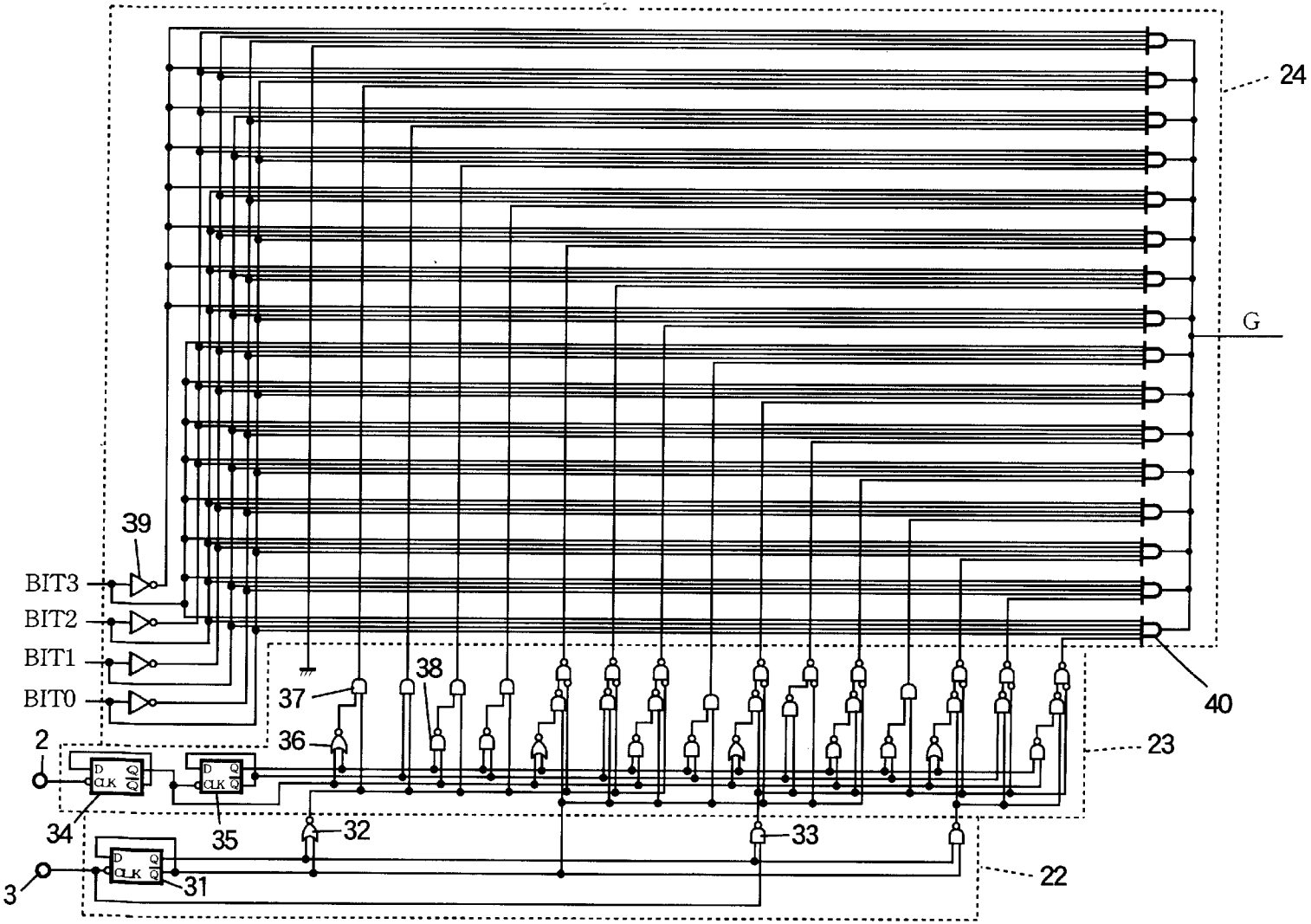
FIG. 7 is a schematic drawing of a frame clock divider, gray-scale waveform generator, and selector in the second embodiment.

FIG. 7 shows the internal structure of the frame clock divider 22, gray-scale waveform generator 23, and selector 24.

The frame clock divider 22 comprises a D-type flip-flop 31. The Q output signal of this flip-flop has half the frequency of the frame clock signal (FCLK). Logic gates such as the NOR gate 32 and NAND gate 33 perform logic operations on FCLK arid the inverted and non-inverted outputs ($\overline{Q}$31 and Q31) of the flip-flop 31 to produce the output signals of the frame clock divider 22.

The gray-scale waveform generator 23 comprises a pair of D-type flip-flops 34 and 35 interconnected so as to divide the frequency of the timing clock signal (TCLK) by two and four, and various Logic gates, among which are, for example, a NOR gate 36, an AND gate 37, and a NAND gate 38. These gates perform logic operations on the non-inverted outputs (Q34 and Q35) of flip-flops 34 and 35, the inverted output ($\overline{Q}$35) of flip-flop 35, and the output signals received from the frame clock divider 22, to generate the sixteen gray-scale waveforms supplied to the selector 24.

The selector 24 comprises four inverters 39 that invert the bit signals (BIT 3, BIT 2, BIT 1, and BIT 0) from the gray-scale memory 21, and sixteen five-input AND gates 40. The five-input AND gates 40 select one of the sixteen output signals from the gray-scale waveform generator 23 according to the values of the bit signals. The outputs of the five-input AND gates 40 are combined by wired-OR logic to produce a gray-scale waveform G that goes high when the output of any one of the five-input AND gates 40 is high.

Figure 8:
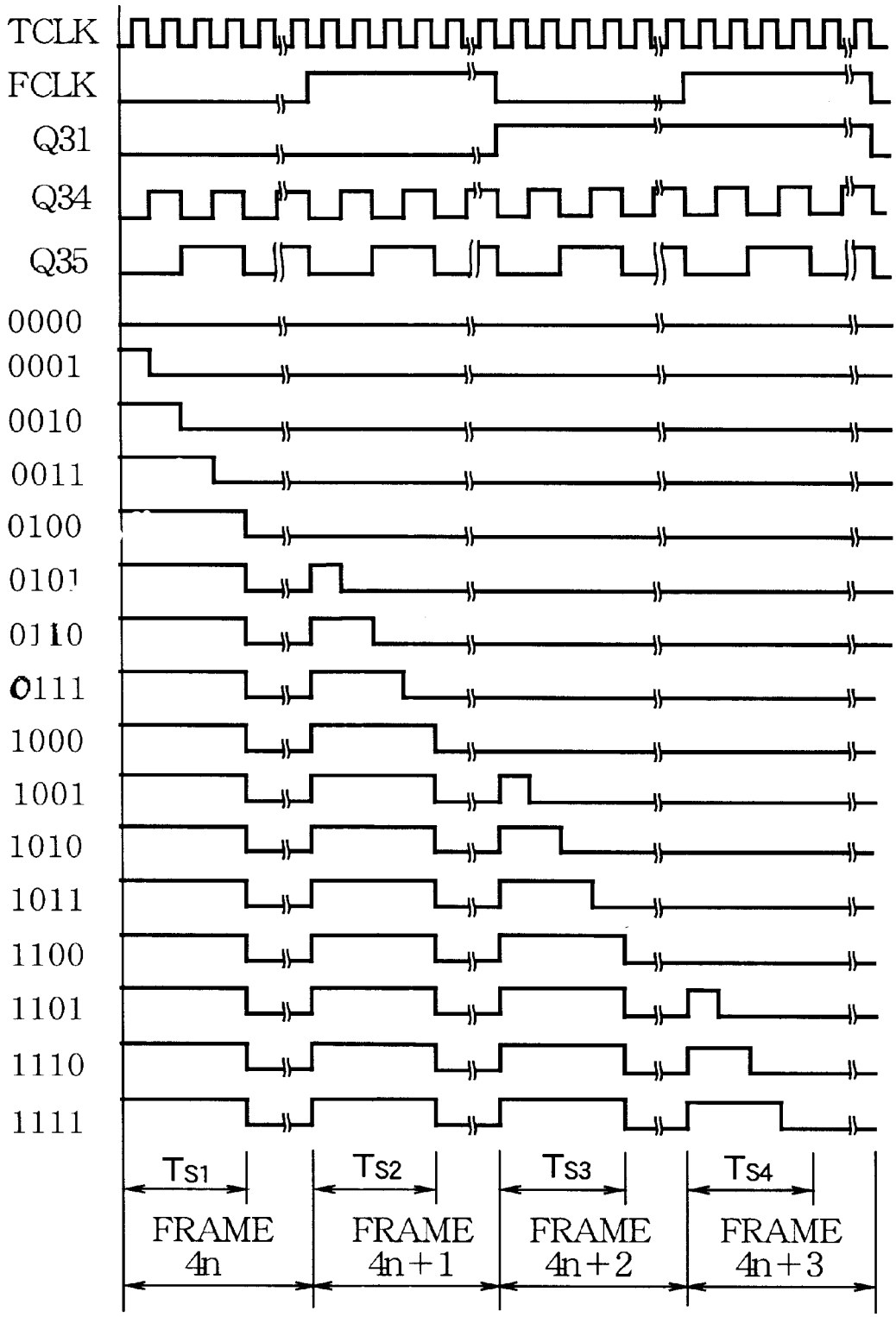
FIG. 8 is a timing diagram illustrating the operation of the second embodiment.

FIG. 8 shows the waveforms of the timing clock (TCLK), the frame clock (FCLK), the divided frame clock Q31 output by flip-flop 31, the divided timing signals Q34 and Q35 output from the Q output terminals of flip-flops 34 and 35, and the gray-scale waveforms G output in the first line-scanning intervals ($T_{S1}$, $T_{S2}$, $T_{S3}$, or $T_{S4}$) of four consecutive frames, for gray levels from zero ('0000') to fifteen ('111'). The frames are numbered from 4*n* to 4*n*+3.

A detailed description of the operation of the second embodiment will be omitted, as the waveforms in FIG. 8 can be directly verified from the logic operations performed in FIG. 7.

When the second embodiment is employed to drive a liquid crystal display, the circuit configuration shown in FIG. 7 is used to drive every fourth column, e.g. to drive columns with column numbers of the form 4*k*, where k is an integer.

In the next adjacent columns (4*k*+1), the waveform timing is offset by one frame by adding an inverter to the frame clock divider 22, and using the inverted frame clock signal ($\overline{\text{FCLK}}$) in place of the non-inverted frame clock signal (FCLK).

In the next adjacent columns (4*k*+2), FCLK is not inverted, but connections of the inverted output ($\overline{Q}$31) and non-inverted output (Q31) of flip-flop 31 are interchanged. The waveform timing is thereby offset by two frames with respect to FIG. 8.

In the next adjacent columns (4*k*+3), FCLK is inverted, and the connections of $\overline{Q}$31 and Q31 are also interchanged. The waveform timing is thereby offset by three frames.

Figure 9:
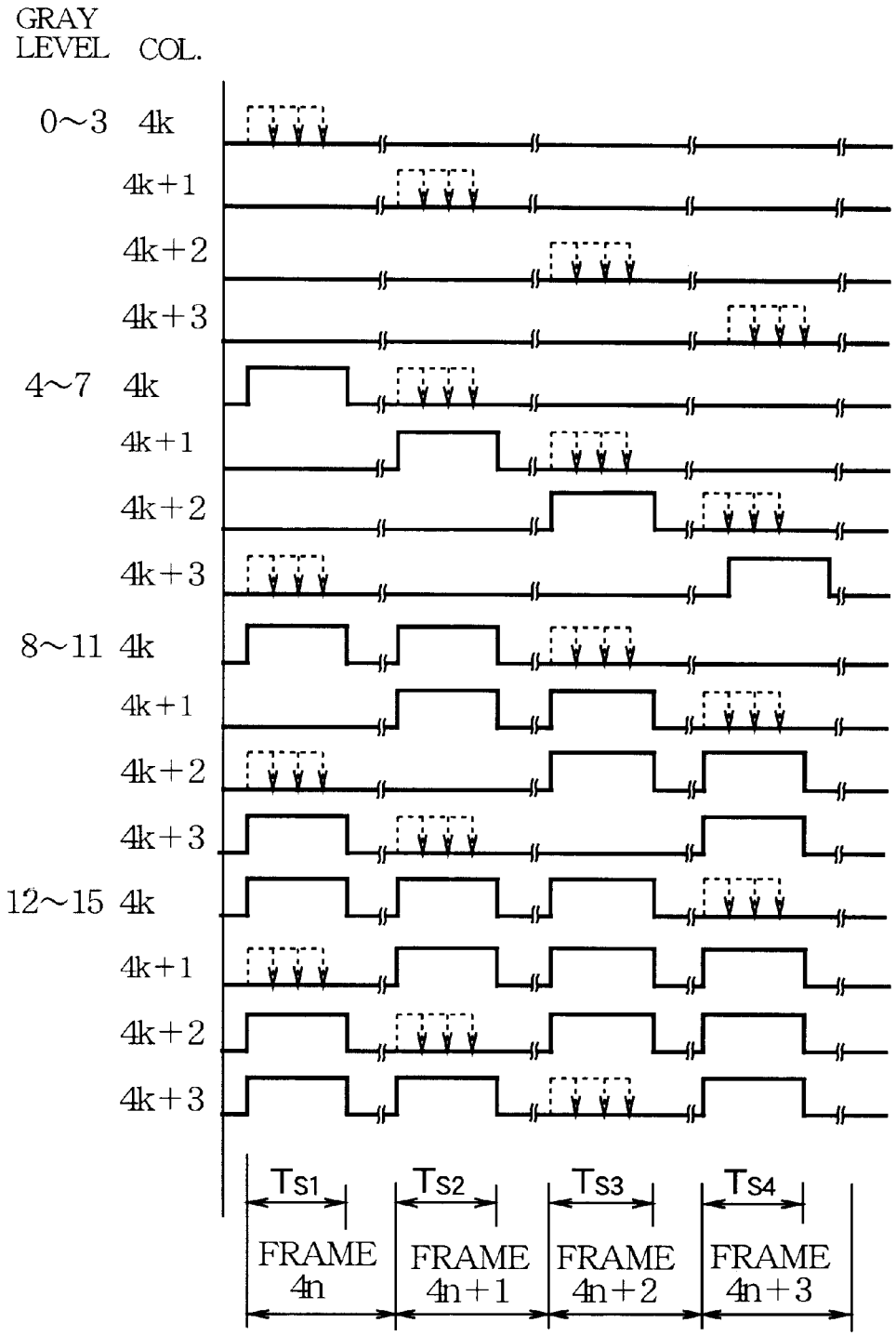
FIG. 9 is a timing diagram illustrating the operation of the second embodiment when used to drive four adjacent columns of picture elements in a liquid crystal display.

FIG. 9 illustrates the gray-scale waveform timing in a group of four columns 4*k*, 4*k*+1, 4*k*+2, and 4*k*+3 during the first line-scanning intervals of four consecutive frames 4*n*, 4*n*+1, 4*n*+2, and 4*n*+3.

If the gray level is from zero to three, a pulse with a width of zero to three-fourths of the line-scanning interval is produced in frame 4*n* for column 4*k*, in frame 4*n*+1 for column 4*k*+1, in frame 4*n*+2 for column 4*k*+2, or in frame 4*n*+3 for column 4*k*+3, as indicated by the dotted arrows in the first four waveforms in FIG. 8.

If the gray level is from four to seven, then for column 4*k*, a pulse with a width of one iine-scanning interval is produced in frame 4*n*, followed by a more narrow pulse in frame 4*n*+1. These pulses slip back to frames 4*n*+1 and 4*n*+2 for column 4*k*+1, and to frames 4*n*+2 and 4*n*+3 for column 4*k*+2. For column 4*k*+3, the wide pulse appears in frame 4*n*+3, and the more narrow pulse in frame 4*n*.

Similar timing offsets can be seen for gray levels eight to eleven, and gray levels twelve to fifteen. As in the first embodiment, the offsets of the waveforms avoid flicker by tending to distribute high output levels equally over all frames.

Compared with the conventional method of producing a gray-scale signal by pulse-width modulation in just one frame, the second embodiment reduces the required timing clock frequency by a factor or four. Considerable power can be saved in this way, and the requirements on the response speed of the liquid crystal material are significantly relaxed.

The present invention is not limited to the two embodiments shown above.

The gray-scale waveform generator and selector are not limited to the logic circuit configurations shown in FIGS. 2 and 7 and many variations are possible.

In FIG. 7, the frame clock divider 22 was shown as performing logic operations on the divided frame clock signals, and the frame clock signal, but these logic operations could of course be performed in the gray-scale waveform generator 23.

The timing offset schemes illustrated in FIGS. 4 and 9 can be refined to prevent flicker of vertical lines, by shifting the output timing from row to row as well as from column to column. In the first embodiment, for example, additional logic can be provided in the gray-scale waveform generator to invert the frame clock signal in alternate line-scanning intervals.

Liquid crystal television is just one of many possible fields in which the invention can be usefully practiced and liquid crystal projectors are another possible application. The invention is potentially applicable to any matrix-addressed device that displays successive image frames, using pulse-width modulation to control the gray levels of the picture elements in the image.

Depending on the type of scanning employed, the gray-scale memory can be eliminated in some applications.

Those skilled in the art will recognize that further variations are possible within the scope claimed below.

What is claimed is:

1. A method of generating a gray-scale signal representing a gray level of a picture element in an image, the method comprising:

dividing an interval in which the picture element is scanned in each of successive frames into a first number of interval parts;

generating a waveform as a set of waveform parts, wherein each of the waveform parts corresponds to one of the interval parts in a second number of successive frames, wherein the second number is greater than one, the set of waveform parts having a number of waveform parts equal to the first number of interval parts multiplied by the second number of successive frames, and each of the waveform parts having a level selected from among a high level and a low level, the level of each of the waveform parts being variable and responsive to the gray level, wherein said generating of the waveform further comprises:

receiving a timing clock signal having a period equal to a period of one of the interval parts, dividing the timing clock signal to create at least one divided timing signal, receiving a frame clock signal having a period equal to a period of at least two of the successive frames, performing logic operations on the at least one divided timing signal and the frame clock signal, thereby generating a plurality of candidate waveforms, and creating the waveform by selection from among the plurality of candidate waveforms, according to the gray level; and generating the gray-scale signal from the waveform.

2. The method of claim 1, wherein said generating of the waveform further comprises dividing the frame clock signal to create a divided frame clock signal, wherein said performing of logic operations also occurs on the divided frame clock signal.

3. A gray-scale signal generating circuit for generating a gray-scale signal representing a gray level of an image for a picture element, the gray-scale signal generating circuit comprising a gray-scale control circuit being operable to divide an interval in which the picture element is scanned in each of successive frames into a first number of interval parts, and further being operable to generate a waveform as a set of waveform parts, wherein each of the waveform parts corresponds to one of the interval parts in a second number of successive frames, wherein the second number is greater than one, the set of waveform parts having a number of waveform parts equal to the first number of interval parts multiplied by the second number of successive frames, and each of the waveform parts having a level selected from among a high level and a low level, the level of each of the waveform parts being variable and responsive to the gray level, wherein said gray scale control circuit comprises:

a gray-scale waveform generator being operable to receive a timing clock signal and a frame clock signal, the timing clock signal having a period equal to a period of one of the interval parts and the frame clock signal having a period equal to a period of at least two of the successive frames, said gray-scale waveform generator further being operable to divide the timing clock signal to create at least one divided timing signal and to perform logic operations on the divided timing signal and the frame clock signal, thereby generating a plurality of candidate waveforms; and a selector coupled to said gray-scale waveform generator, said selector being operable to create the waveform generated by said gray-scale control circuit by selecting the waveform from among the plurality of candidate waveforns generated by said gray-scale waveform generator.

4. The gray-scale signal generating circuit of claim 3, wherein said gray-scale control circuit further comprises a frame clock divider coupled to said gray-scale waveform generator, said frame clock divider being operable to divide the frame clock signal to create a divided frame clock signal, and said gray-scale waveform generator also being operable to perform logic operations on the divided frame clock signal to generate the plurality of candidate waveforms.

5. The gray-scale signal generating circuit of claim 3, wherein said gray-scale control circuit further comprises a gray scale memory coupled to said selector, said gray-scale memory being operable to store data indicating the gray level of the picture element and to supply the data to said selector in each of the successive frames.

6. A liquid crystal display having picture elements arranged in rows and columns for displaying an image made up of successive frames, the liquid crystal display comprising:

a gray-scale control circuit for each of the columns, each of said gray-scale control circuits being operable to divide an interval in which a row is scanned in each of the successive frames into a first number of interval parts and to generate a waveform for a column as a set of waveform parts spanning a second number of successive frames, wherein the second number is greater than one, the waveform having for each of the picture elements in the column, a number of waveform parts equal to the first number of interval parts multiplied by the second number of successive frames, each of the waveform parts having a level selected from among a high level and a low level, the level of each of the waveform parts being variable and responsive to the gray levels of each of the picture elements;

at least one gray-scale waveform generator being operable to receive a timing clock signal and a frame clock signal, the timing clock signal having a period equal to a period of one of the interval parts and the frame clock signal having a period equal to a period of at least two of the successive frames, said at least one gray-scale waveform generator being further operable to divide the timing clock signal to create at least one divided timing signal and to perform logic operations on the divided timing signal and the frame clock signal, thereby generating a plurality of candidate waveforms; and wherein each of said gray-scale control circuits comprises a selector, each said selector being coupled to said at least one gray-scale control circuit, and each said selector being operable to create the waveform generated by the respective said gray-scale control circuits by selecting the waveform from among the candidate waveforms generated by said at least one gray-scale waveform generator, according to the gray levels of the picture elements.

7. The liquid crystal display of claim 6, further comprising a frame clock divider coupled to said at least one gray-scale waveform generator, said frame clock divider being operable to divide the frame clock signal to create a divided frame clock signal, wherein said at least one gray-scale waveform generator being further operable to perform logic operations on the divided frame clock signal to generate the plurality of candidate waveforms.

8. The liquid crystal display of claim 6, wherein each of said gray-scale control circuits further comprises a gray-scale memory, each of said gray-scale memories being operable to store the gray level of at least one of the picture elements in the column.

9. The liquid crystal display of claim 6, wherein said at least one gray-scale waveform generator comprises at least two gray-scale waveform generators, each of said at least two gray-scale waveform generators being operable to perform different logic operations, thereby generating pluralities of candidate waveforms, wherein the columns are arranged in groups and in each of the groups, said gray-scale control circuit for each of the columns in each of the groups being coupled to one of said at least two gray-scale waveform generators; and each of the pluralities of candidate waveforms generated by said at least two gray-level waveform generators differ so that, even if all of the picture elements in a row have identical gray-levels, within each of the groups, the waveforms generated by each of said at least two gray-scale control circuits do not all go high and low in unison.

10. The liquid crystal display of clain 9, wherein each of the groups comprises a number of columns, and the waveforms generated by respective said gray-scale control circuits for different columns in each of the groups, for identical gray levels, are mutually offset from each other in steps of one frame.

* * * * *